US006086010A

United States Patent [19]

Kayser

[11] Patent Number: 6,086,010

[45] Date of Patent: Jul. 11, 2000

[54] PROCESS FOR TRANSFERRING A MATERIAL WEB FROM A WINDING ROLL TO A WINDING SLEEVE AND WINDING DEVICE

[75] Inventor: Franz Kayser, Geldern, Germany

[73] Assignee: Voith Sulzer Papiertechnik Patent GmbH, Heidenheim, Germany

[21] Appl. No.: 09/255,716

[22] Filed: Feb. 23, 1999

[30] Foreign Application Priority Data

Feb. 26, 1998 [DE] Germany ..... 198 08 041

[51] Int. Cl.[7] ..... B65H 35/10

[52] U.S. Cl. ..... 242/521; 242/527.6; 242/527.7; 242/532.3; 242/533.2; 242/527.5

[58] Field of Search ..... 242/526.1, 521, 242/527.5, 527.6, 532.3, 533.2, 527.7

[56] References Cited

U.S. PATENT DOCUMENTS

| | | | |
|---|---|---|---|
| 4,422,588 | 12/1983 | Nowisch | 242/527.6 X |
| 4,485,979 | 12/1984 | Dropczynski | 242/532.3 X |
| 4,775,110 | 10/1988 | Welp et al. | 242/521 |
| 5,222,679 | 6/1993 | Dropczynski et al. | 242/521 |
| 5,273,226 | 12/1993 | Dropczynski | 242/521 |
| 5,413,656 | 5/1995 | Kühnhold et al. . | |
| 5,577,684 | 11/1996 | Dropczynski et al. | 242/533.2 |
| 5,795,432 | 8/1998 | Urban | 242/527.6 X |
| 5,845,866 | 12/1998 | Kaipf | 242/521 |
| 5,911,384 | 6/1999 | Peters | 242/533.2 X |

FOREIGN PATENT DOCUMENTS

| | | | |
|---|---|---|---|
| 0442038 | 8/1991 | European Pat. Off. . | |
| 442038 | 8/1991 | European Pat. Off. . | |
| 0512196 | 11/1992 | European Pat. Off. . | |
| 512196 | 11/1992 | European Pat. Off. . | |
| 2625486 | 7/1989 | France . | |
| 3151267 | 10/1983 | Germany . | |
| 3640724 | 6/1987 | Germany . | |
| 3904598 | 8/1990 | Germany . | |
| 40 29 180 | 3/1992 | Germany | 242/532.3 |
| 4029180 | 3/1992 | Germany . | |
| 4115406 | 11/1992 | Germany . | |
| 92/05100 | 4/1992 | WIPO . | |
| 98/17564 | 4/1998 | WIPO . | |

*Primary Examiner*—Donald P. Walsh
*Assistant Examiner*—Minh-Chau Pham
*Attorney, Agent, or Firm*—Greenblum & Bernstein, P.L.C.

[57] ABSTRACT

Winding device and process for transferring a material web from a wound roll to a winding sleeve in a transfer region of the winding device. The process includes cutting the web in a cross-wise direction at a position upstream from the transfer region with respect to a web travel direction. In this way, a cutting line forms a leading edge and a trailing edge. The process also includes applying a double-sided adhesive tape along the cutting line, moving the cutting line into the transfer region, and increasing a web tension. In this way, the double sided adhesive tape is torn along the cutting line, which separates the trailing edge from the leading edge. The process also includes sticking the trailing edge onto the wound roll, and sticking the leading edge onto the winding sleeve. The winding device includes a cutting device that cuts the material web in a cross-wise direction. In this manner, a cutting line forms a leading and trailing edge. The device also includes an applying device that applies a double-sided adhesive tape, and that is positioned to follow the cutting device, such that the adhesive tape is applied while the cutting line is being made. The device also includes a transfer region in which the trailing edge is to be stuck to a wound roll and the leading edge is to be stuck to a winding sleeve, and the cutting device and the applying device are located at a distance upstream of the transfer region, with respect to a web travel direction.

23 Claims, 2 Drawing Sheets

PROCESS FOR TRANSFERRING A MATERIAL WEB FROM A WINDING ROLL TO A WINDING SLEEVE AND WINDING DEVICE

CROSS-REFERENCE TO RELATED APPLICATIONS

The present application claims priority under 35 U.S.C. §119 of German Patent Application No. 198 08 041.7, filed on Feb. 26, 1998, the disclosure of which is expressly incorporated by reference herein in its entirety.

BACKGROUND OF THE INVENTION

1. Field of the Invention

The present invention relates to a process for transferring a material web from a wound roll to a winding sleeve. The web is completely cut in the cross-wise or lateral direction and is provided with a double-sided adhesive tape. In a transfer region, the web end is stuck to the wound roll and the web beginning is stuck to the winding sleeve.

The present invention also relates to a winding device for a material web that includes a cutting device, which completely cuts the material web in the cross-wise or lateral direction, an applying device that applies a double-sided adhesive tape, and a transfer region in which the web end is stuck to the wound roll and the web beginning is stuck to a winding sleeve.

2. Discussion of the Background Information

In prior art document EP 0 512 196 B1, a cutting device and adhesive tape applying device are located within a transfer region, i.e., at the location at which the cutting of the material web produces a preceding web end (or trailing edge) and a subsequent web beginning (or leading edge). These two ends must be handled differently in order to be respectively stuck or adhered to the wound roll and the winding sleeve, respectively. However, locating both the cutting device and the applying device within the transfer region causes space problems and limits freedom of design.

In a device disclosed in EP 0 442 038 B1, the material web is weakened by perforation at a distance before, i.e., upstream from, the transfer region and double-sided adhesive tape is applied to both sides of the perforation. The web is then further transported until the perforation is located within the transfer region. The web tension is increased so as to tear the web along the perforation. In this regard, the perforation device must be adapted to the specific material being wound so that the weakening is not excessive, i.e., such that the web tears at a normal transport tension before reaching the transfer region, and so that the weakening is sufficient for the web to be cut in the transfer region.

SUMMARY OF THE INVENTION

The present invention provides a transfer region that is free of the cutting device and the adhesive tape applying device, and that does not experience the occurrence of difficulties associated with the weakening of the material web.

In this regard, the process of the present invention provides that the web is cut before the transfer region and that the cutting line is covered over with the adhesive tape, that the web is further transported until the cutting line is located within the transfer region, and that the adhesive tape is torn within the transfer region by increasing the web tension.

With this process, the web is completely cut before reaching the transfer region. Thus, clean edges are obtained with the final cut. Moreover, the adhesive tape provides a connection between the preceding web end (i.e., the trailing edge of the wound roll) and the subsequent web beginning (i.e., the leading edge to be adhered to the winding sleeve) during the further transporting of the material web into the transfer region. The tearing force necessary for the final separation of the web end and the web beginning, i.e., the required increase in web tension from normal web transport, may be determined from the tear strength of the adhesive tape. Thus, adaptations to the web material are not necessary or are only required in rare instances. Since the tear strength of the adhesive tape is known, the web tensions may be selected in advance so that optimal operating conditions are produced.

Advantageously, the transfer region includes the winding bed of a carrying roll winding device. In the present invention, it is particularly important to keep the transfer region free of the cutting device and the applying device.

It may be preferable to stick the adhesive tape over the cutting line during the cutting. In this way, the web end and web beginning may be substantially continuously secured to each other despite the complete cutting. Further, since cutting and taping take place in one work cycle, the transfer procedure may be curtailed.

Preferably, the tearing of the adhesive tape may occur during ejection of the wound roll. In this instance, increased web tension may occur when the web is held or braked on the beginning end side of the cutting line. Since a separate work cycle is not necessary for performing the tearing, a more rapid transfer process results.

It may also be preferable that, after the tearing of the adhesive tape, the wound roll is moved solely by the ejection process. In this instance, the web end may be pressed against a circumference of the wound roll along a line that extends along a circumferential direction until the web end is stuck onto the wound roll. With this measure, it is not necessary to further actuate a rotation drive of the wound roll to stick the web end on.

The structure of the device of the present invention includes a cutting device and an applying device arranged at a distance before or upstream of a transfer region, wherein the applying device follows downstream of the cutting device to cover the cutting line with adhesive tape. The same advantages that were described in connection with the process according to the present invention may be achieved.

It may be preferable that two carrying rolls be provided for the wound roll and that the transfer region include the winding bed of the carrying rolls.

Preferably, the cutting device and the applying device may be affixed to a common support that can be moved lateral to the material web. In this manner, the cutting device and the applying device can be secured at a slight distance from each other so that a section of the cutting line that is not covered by the adhesive tape is small.

In particular, an ejection device can be disposed adjacent to the winding bed and when the ejection device is actuated, the adhesive tape is torn. Thus, no other auxiliary device is necessary to exert the tearing force.

Further, a pressing element that can be placed against the circumference of a wound roll may be preferable. In this way, upon the ejection movement of the wound roll, the pressing element may be moved over the circumference of the wound roll. In this manner, a rotational drive of the wound roll is not necessary after the tearing of the adhesive tape.

It may be preferable to provide, in connection with the ejection device, an ejection tube that is supported on ejection levers which can be pivoted around an axis beneath the wound roll. The ejection levers may support pressing levers that carry the pressing element and that are actuated by a hydraulic cylinder. This particular arrangement may produce a particularly simple embodiment.

Accordingly, the present invention is directed to a process for transferring a material web from a wound roll to a winding sleeve in a transfer region of a winding device. The process includes cutting the web in a cross-wise direction at a position upstream from the transfer region with respect to a web travel direction. In this way, a cutting line forms a leading edge and a trailing edge. The process also includes applying a double-sided adhesive tape along the cutting line, moving the cutting line into the transfer region, and increasing web tension. In this way, the double sided adhesive tape is torn along the cutting line, which separates the trailing edge from the leading edge. The process also includes sticking the trailing edge onto the wound roll, and sticking the leading edge onto the winding sleeve.

In accordance with another feature of the present invention, the winding device is composed of a carrying roll winder and the transfer region includes a winding bed of the carrying roll winder.

In accordance with another feature of the present invention, the adhesive tape is applied along the cutting line during the cutting of the web.

In accordance with still another feature of the present invention, the increasing of the web tension includes ejecting the wound roll from the winding device.

In accordance with a further feature of the present invention, after the adhesive tape is torn, the process further includes ejecting the wound roll from the winding device, and pressing the trailing edge against a circumference of the wound roll in a circumferential direction until the web end is stuck on.

In accordance with another feature of the present invention, the process further includes holding the web in place during the cutting of the web. Further, the web may be held substantially free of web tension.

In accordance with still another feature of the present invention, the process further including ejecting the wound roll from the winding bed, inserting the roll sleeve into the winding bed during the ejection of the wound roll, and retaining the leading edge in the winding bed during the ejection of the wound roll.

In accordance with a still further feature of the present invention, when the cutting line is positioned within the transfer region, the process further includes holding the web against movement, and lifting the wound roll with an ejection device. The lifting of the wound roll provides the increased web tension.

In accordance with still another feature of the present invention, the process further including moving a pressing device in a circumferential direction of the wound roll over the trailing edge.

The present invention is also directed to a winding device for a material web that includes a cutting device that cuts the material web in a cross-wise direction. In this manner, a cutting line forms a leading and trailing edge. The device also includes an applying device that applies a double-sided adhesive tape, and that is positioned to follow the cutting device, such that the adhesive tape is applied while the cutting line is being made. The device also includes a transfer region in which the trailing edge is to be stuck to a wound roll and the leading edge is to be stuck to a winding sleeve, and the cutting device and the applying device are located at a distance upstream of the transfer region, with respect to a web travel direction.

In accordance with another feature of the present invention, two carrying rolls are arranged to support the wound roll and to define a winding bed, which is included within the transfer region.

In accordance with still another feature of the present invention, the cutting device and the applying device is coupled to a common carrier. The common carrier may be movable in a cross-wise direction relative to the material web.

In accordance with a further feature of the present invention, a winding bed may be adapted to support the wound roll, and an ejection device may be positioned adjacent to the winding bed and being adapted to remove the wound roll from the winding bed, and thereby tear the adhesive tape.

In accordance with a still further feature of the present invention, a pressing element may be adapted to be placed against a circumference of the wound roll being movable over the circumference of the wound roll in a circumferential direction. During ejection of the wound roll from the winding device, the pressing element may be moved over the circumference of the wound roll. Further, an ejection device including an ejection tube supported on ejection levers that are pivotable around an axis beneath the wound roll may be provided. The ejection levers, arranged to support pressing levers that carry pressing elements, may be hydraulically actuatable. Further still, hydraulic cylinders may be coupled to the ejection levers.

In accordance with another feature of the present invention, the transfer region may be composed of two support rolls forming a winding bed, and a retaining device movable to press against one of the support rolls may be provided.

In accordance with still another feature of the present invention, the transfer region may be composed of two support rolls forming a winding bed, and a movable receptacle adapted to retain the winding sleeve and to insert the winding sleeve into the winding bed may be provided.

In accordance with yet another feature of the present invention, the cutting device may include a cutting wheel and an opposing plate. Further, the opposing plate includes a gap adapted to receive a portion of the cutting wheel.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
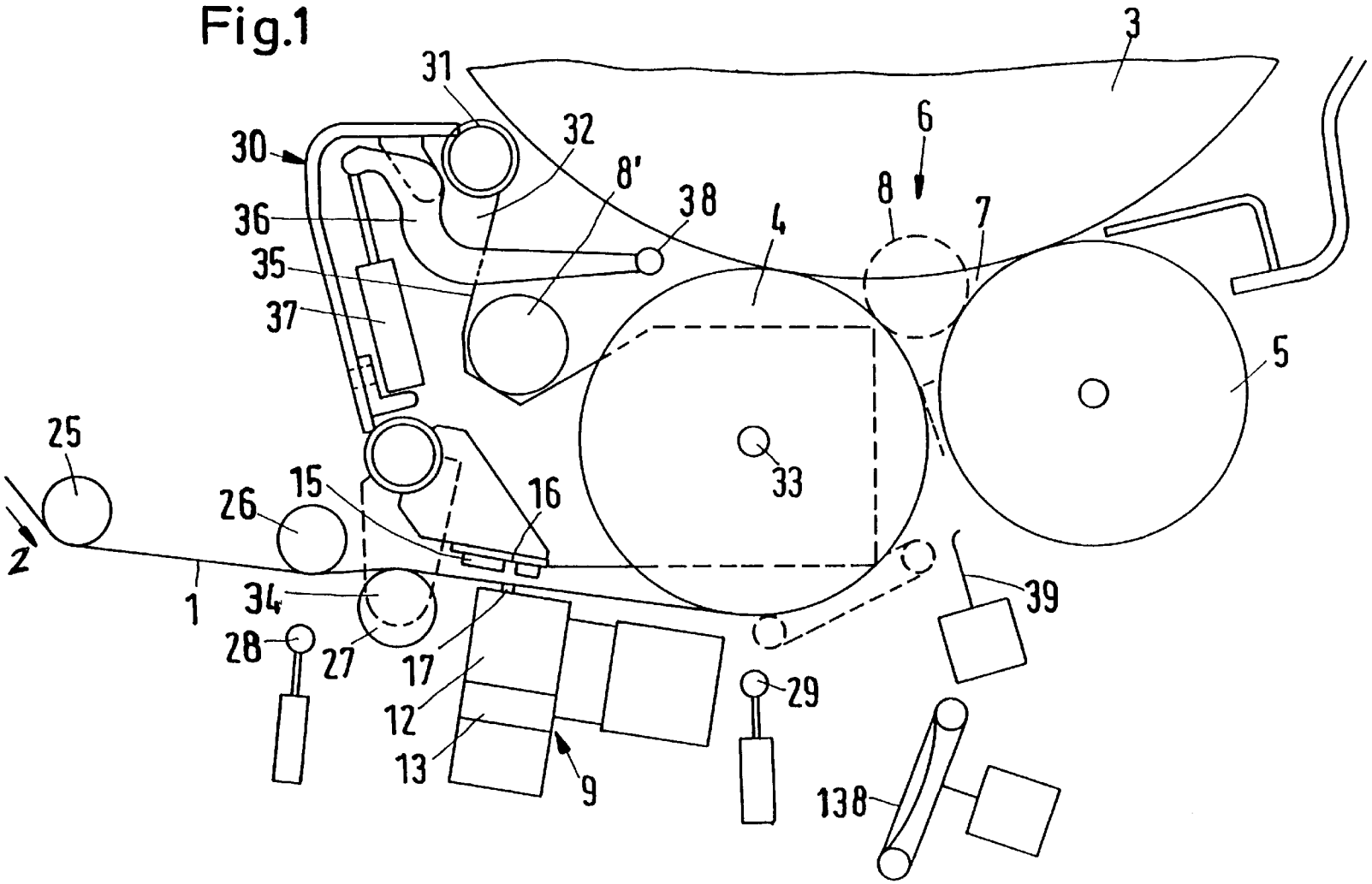
FIG. 1 schematically illustrates a part of a winding device according to the present invention.

A carrying roll winding device is schematically illustrated in FIG. 1. A web 1, e.g., a paper or cardboard web, may be guided in a direction of arrow 2 to be wound into a wound roll 3, which is positioned to rest on carrying rolls 4 and 5. At least one of carrying rolls 4 and 5 may be driven, which rotationally drives wound roll 3. When wound roll 3 has reached a maximal or desired diameter, web 1 must be cut in a crosswise or lateral direction so that, in a transfer region 6 that includes a winding bed 7, a preceding web end (trailing edge) of the cut web may be stuck onto wound roll 3 and a subsequent web beginning (leading edge) of the cut web may be stuck to a new winding sleeve 8.

Figure 2:
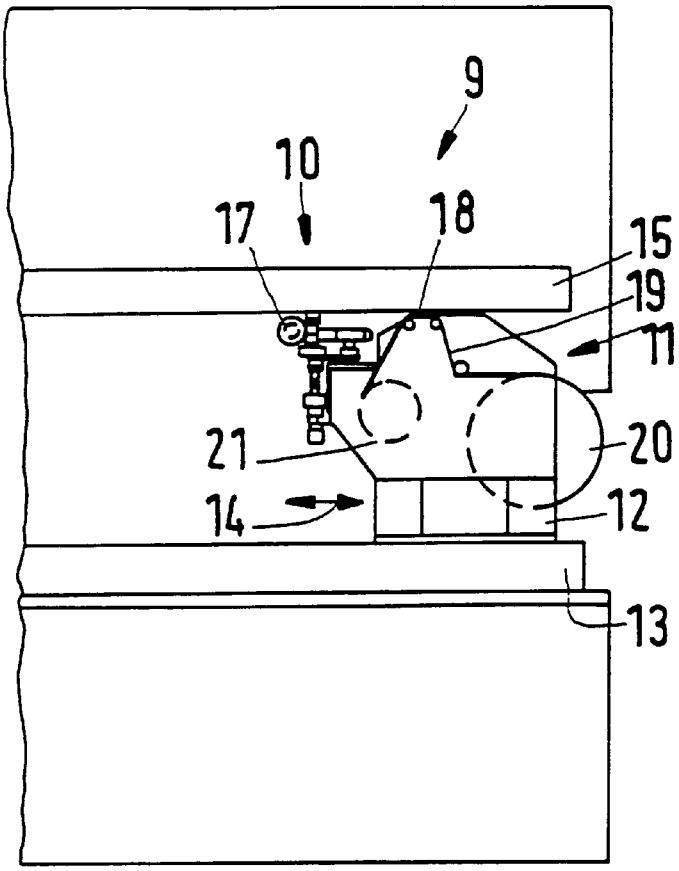
FIG. 2 illustrates a section line through the combined cutting and adhesive tape applying devices.

A standard component 9, which includes a cutting device 10 and an adhesive tape applying device 11, may be located at a distance before or upstream of the transfer region 6 relative to the web travel direction. As illustrated in FIG. 2, both devices may be supported by a common carrier 12, e.g., a cradle, which can be moved along a track 13 in a direction of double arrow 14, i.e., cross-wise to material web 1. On an opposite side of material web 1, an opposing plate 15 may be arranged, which can be pivoted toward web 1 and which may include a groove 16 for receiving a blade 17 of cutting device 10. Adjacent to, and just after blade 17, applying device 11 is provided, which includes an application region 18 in which a double sided adhesive tape 19 is taken off of a storage roll 20 to be applied to web 1. Thus, it is noted that cutting of web 1 occurs as common carrier 12 is moved so that applying device 11 follows cutting device 10. Movement in the opposite direction is utilized for resetting common carrier 12. A carrying belt of the adhesive tape may be wound onto a discard roll 21.

Figure 3:
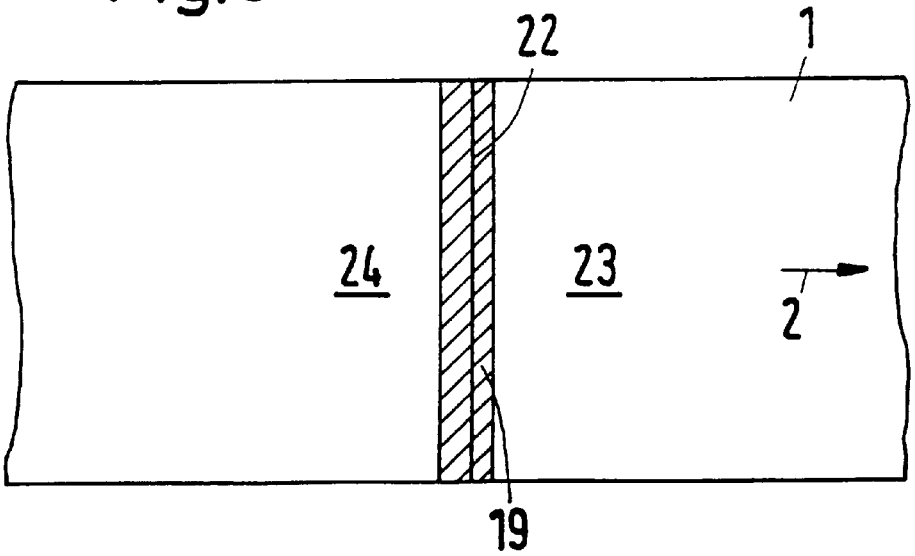
FIG. 3 illustrates a top view of the a material web in accordance with the present invention.

As illustrated in FIG. 3, with a continuously operating cutting blade 17, cutting device 10 produces a cutting line 22 that completely cuts web material 1. Cutting line 22, however, may be completely covered by adhesive tape 19. Therefore, while trailing edge 23 and leading edge 24 are formed by the cutting, the two edges are held together by adhesive tape 19. The cutting and adhesive application may be performed while web 1 is stopped.

Web 1, which may be supplied by way of guide rolls 25 and 26, as well as a spreader roll 27, may be clamped to guide roll 26 via a first clamping element 28 and may be clamped to carrying roll 4 via a second clamping element 29. In this manner, cutting line 22 is not under tension.

After the cutting and application of adhesive tape 19, web 1 may be driven until cutting line 22 is located within transfer region 6. Clamping element 29 may again clamp web 1 to carrying roll 4 and an ejection device 30 may be actuated to eject wound roll 3 toward the right. This ejection increases the web tension so that adhesive tape 19 tears along cutting line 22. At this point, trailing edge 23 and leading edge 24 are free from each other and may be stuck onto wound roll 3 and onto a new winding sleeve 8, respectively.

Ejection device 30 may include an ejection tube 31, which engages the circumference of wound roll 3, and may be supported on ejection levers 32 that can be pivoted around a rotation point 33 of carrying roll 4, e.g., via a hydraulic cylinder (not shown) that engages a boom 34. A receptacle 35 may be provided on ejection levers 32, which may retain a new winding sleeve 8' that automatically falls into winding bed 7 upon ejection of wound roll 3. Further, opposing plate 15 may also be supported by ejection levers 32.

Moreover, ejection levers 32 may support pressing levers 36 that can be pivoted via hydraulic cylinders 37 and the free end of pressing levers 36 may support a pressing element 38 in the form of a split pressing roll. Upon ejection of wound roll 3, pressing element 38 may be pressed against the circumference of wound roll 3 and may be inserted far into a gap between wound roll 3 and carrying roll 4 to press trailing edge 23 against wound roll 3 without requiring the carrying roll drive to be switched on again. When new winding sleeve 8' enters winding bed 7, its circumference adheres to leading edge 24. As soon as the winding device has started up again, a new wound roll is wound onto winding sleeve 8.

Other auxiliary devices are schematically indicated. For example, guide device 138 may be pivoted against carrying roll 4 into the position depicted in dashed lines to secure leading edge 23 against becoming detached from the carrying roll 4. In a similar fashion, a spring clip 39 may be provided to slide through the gap between carrying rolls 4 and 5 and into the position depicted in dashed lines.

The exemplary embodiment of the present invention may be departed from in many respects without forsaking the fundamental concepts of the invention. For example, in lieu of clamping element 29, carrying roll 4 can be provided with a suction device. The principle of the present invention may be suitable, not only for carrying roll winders, but also for winders with a support roll.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A process for transferring a material web from a wound roll to a winding sleeve in a transfer region of a winding device, comprising:

separating the web in a cross-wise direction at a position upstream from the transfer region with respect to a web travel direction with a straight separation line, whereby the straight separation line forms a leading edge and a trailing edge;

applying a double-sided adhesive tape along the straight separation line;

moving the straight separation line into the transfer region;

increasing a web tension, whereby the double sided adhesive tape is torn along the straight separation line, which separates the trailing edge from the leading edge;

sticking the trailing edge onto the wound roll; and sticking the leading edge onto the winding sleeve.

2. The process according to claim 1, wherein the winding device is composed of a carrying roll winder and the transfer region includes a winding bed of the carrying roll winder.

3. The process according to claim 1, wherein the adhesive tape is applied along the straight separation line during the separating of the web.

4. The process according to claim 1, the increasing of the web tension comprising: ejecting the wound roll from the winding device.

5. The process according to claim 1, after the adhesive tape is torn, the process further comprising:

ejecting the wound roll from the winding device; and pressing the trailing edge against a circumference of the wound roll in a circumferential direction until the web end is stuck on.

6. The process according to claim 1, further comprising:

holding the web in place during the separating of the web.

7. The process according to claim 6, wherein the web is held substantially free of web tension.

8. The process according to claim 1, further comprising:

ejecting the wound roll from the winding bed;

inserting the roll sleeve into the winding bed during the ejection of the wound roll; and retaining the leading edge in the winding bed during the ejection of the wound roll.

9. The process according to claim 1, wherein when the straight separation line is positioned within the transfer region, the process further comprises:

holding the web against movement;

lifting the wound roll with an ejection device, wherein the lifting of the wound roll provides the increased web tension.

10. The process according to claim 1, further comprising moving a pressing device in a circumferential direction of the wound roll over the trailing edge.

11. A winding device for a material web comprising:

a cutting device that cuts the material web in a cross-wise direction, whereby a cutting line forms a leading and trailing edge;

an applying device that applies a double-sided adhesive tape, the applying device being positioned to follow the cutting device, whereby the adhesive tape is applied while the cutting line is being made;

a transfer region in which the trailing edge is to be stuck to a wound roll and the leading edge is to be stuck to a winding sleeve;

the cutting device and the applying device being located at a distance upstream of the transfer region, with respect to a web travel direction.

12. The device according to claim 11, further comprising:

two carrying rolls arranged to support the wound roll and to define a winding bed, which is included within the transfer region.

13. The device according to claim 11, the cutting device and the applying device being coupled to a common carrier.

14. The device according to claim 13, the common carrier being movable in a cross-wise direction relative to the material web.

15. The device according to claim 11, further comprising:

a winding bed adapted to support the wound roll;

an ejection device positioned adjacent to the winding bed and being adapted to remove the wound roll from the winding bed, and thereby tear the adhesive tape.

16. The device according to claim 11, further comprising a pressing element adapted to be placed against a circumference of the wound roll being movable over the circumference of the wound roll in a circumferential direction, wherein, during ejection of the wound roll from the winding device, the pressing element is moved over the circumference of the wound roll.

17. The device according to claim 16, further comprising an ejection device comprising an ejection tube supported on ejection levers that are pivotable around an axis beneath the wound roll;

wherein the ejection levers, being arranged to support pressing levers that carry pressing elements, are hydraulically actuatable.

18. The device according to claim 17, further comprising hydraulic cylinders coupled to the ejection levers.

19. The device according to claim 11, the transfer region composed of two support rolls forming a winding bed, and the device further comprising:

a retaining device movable to press against one of the support rolls.

20. The device according to claim 11, the transfer region composed of two support rolls forming a winding bed, and the device further comprising:

a movable receptacle adapted to retain the winding sleeve and to insert the winding sleeve into the winding bed.

21. The device according to claim 11, the cutting device comprising a cutting wheel and an opposing plate.

22. The device according to claim 21, the opposing plate comprising a gap adapted to receive a portion of the cutting wheel.

23. A process for transferring a material web from a wound roll to a winding sleeve in a transfer region of a winding device, comprising:

cutting a cross-wise line in the web at a position upstream from the transfer region with respect to a web travel direction to completely sever the web and to thereby form a clean leading edge and a clean trailing edge;

applying a double-sided adhesive tape along the cross-wise line;

moving the cross-wise line into the transfer region; and increasing web tension to tear the double sided adhesive tape at the cross-wise line.

* * * * *